US005833105A

United States Patent [19]

Stuber

[11] Patent Number: 5,833,105

[45] Date of Patent: Nov. 10, 1998

[54] STAMPING PRESS DAMPED FOLLOWER LOOP CONTROL SYSTEM

[75] Inventor: David M. Stuber, Beaufort, S.C.

[73] Assignee: The Minster Machine Company, Minster, Ohio

[21] Appl. No.: 955,273

[22] Filed: Oct. 21, 1997

Related U.S. Application Data

[63] Continuation of Ser. No. 588,991, Jan. 19, 1996, abandoned.

[51] Int. Cl.[6] ..... B65H 23/18; B65H 20/24; B23Q 15/00

[52] U.S. Cl. ..... 226/4; 226/8; 226/43; 226/117

[58] Field of Search ..... 226/4, 8, 42, 43, 226/111, 115, 117, 118

[56] References Cited

U.S. PATENT DOCUMENTS

| | | | |
|---|---|---|---|
| 2,828,455 | 3/1958 | Kraay et al. | 226/43 |
| 3,667,664 | 6/1972 | Schroeder | 226/30 |
| 3,762,198 | 10/1973 | Bair | 72/28 |
| 3,764,050 | 10/1973 | Clark | 276/111 |
| 3,817,067 | 6/1974 | Vorehes | 72/12 |
| 3,888,400 | 6/1975 | Wiig | 226/43 |
| 3,913,119 | 10/1975 | Pfeifer et al. | 226/43 |
| 3,940,042 | 2/1976 | Kech | 226/111 |
| 4,294,170 | 10/1981 | Takahashi | 100/216 |
| 4,384,665 | 5/1983 | Waddington | 226/42 |
| 4,464,916 | 8/1984 | Grew | 72/17 |
| 4,561,581 | 12/1985 | Kelly | 226/117 |
| 5,219,109 | 6/1993 | Shirono | 226/111 |
| 5,392,977 | 2/1995 | Kato | 226/118 |
| 5,501,412 | 3/1996 | McAleavey | 226/118 |
| 5,560,527 | 10/1996 | Meschi | 226/118 |

FOREIGN PATENT DOCUMENTS

| | | | |
|---|---|---|---|
| 3068386 | 6/1978 | Japan | 226/43 |

*Primary Examiner*—Rodney H. Bonck
*Assistant Examiner*—Matthew A. Kaness
*Attorney, Agent, or Firm*—Randall J. Knuth

[57] ABSTRACT

Stock material is supplied to a machine press by a coiled material supply apparatus which utilizes a damped follower loop control system for distributing loop reaction among two separate loops so as to reduce coil material slippage and deformation caused by high material acceleration and deceleration forces caused by an intermittent feed device. Coiled material is advanced into a coil straightener section via feed rollers and is then advanced into an intermediate damped follower drive roller section, which advances the stock material toward the intermittent feed device. An electronic controller monitors loop and press positions and generates drive signals for controlling the feed rollers, the damped follower drive rollers and the intermittent feed device to maintain optimum velocity profiles of the coil material stock being advanced at each drive roller section. By more evenly distributing the loop reaction associated with the intermittent feed device, the effects of high material acceleration and deceleration, material slippage and deformation, are lessened.

32 Claims, 3 Drawing Sheets

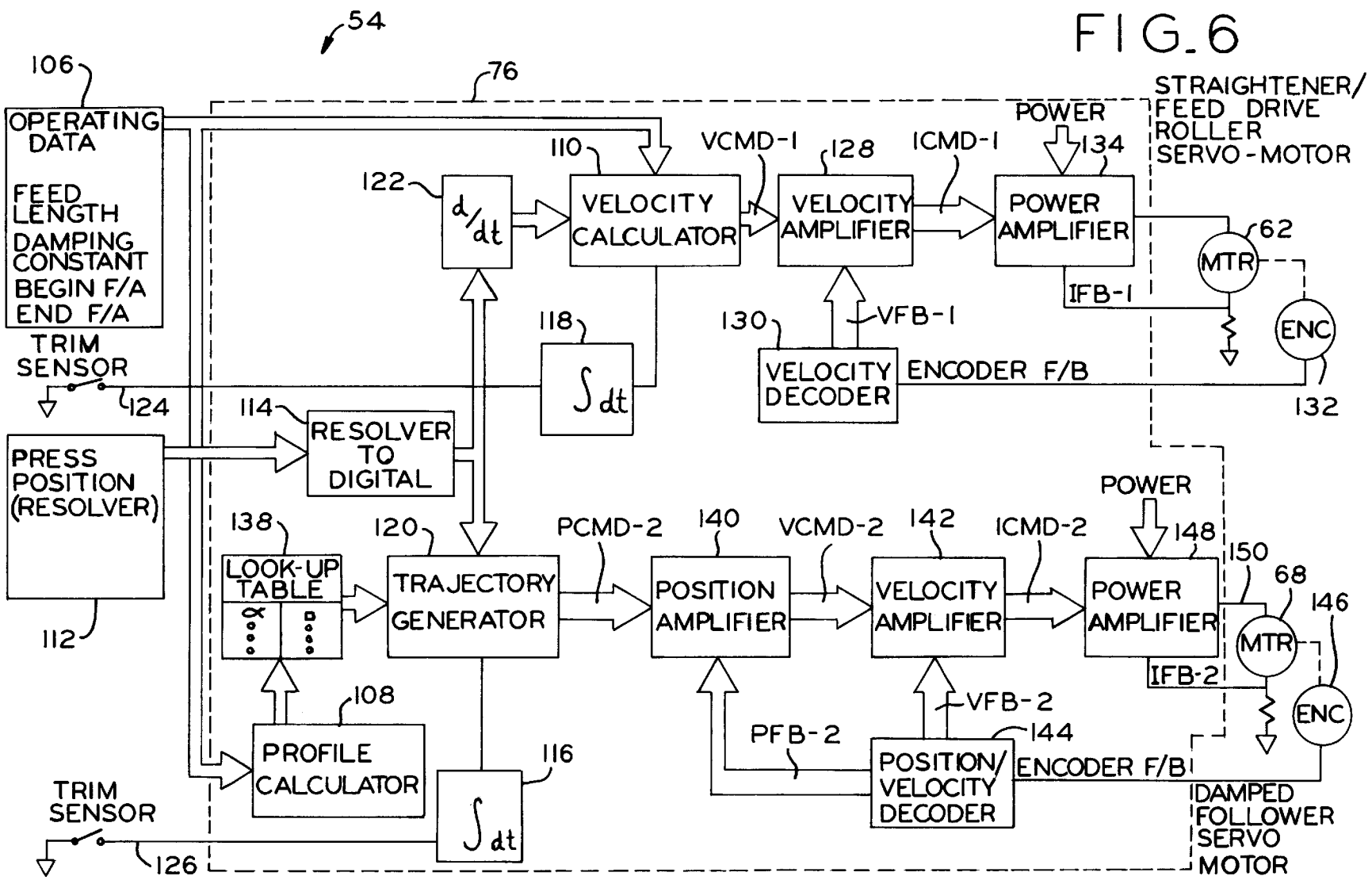
FIG. 6
STRAIGHTENER/ FEED DRIVE ROLLER SERVO-MOTOR
DAMPED FOLLOWER SERVO MOTOR
POWER AMPLIFIER
VELOCITY AMPLIFIER
VELOCITY DECODER
VELOCITY CALCULATOR
POSITION AMPLIFIER
POSITION/ VELOCITY DECODER
TRAJECTORY GENERATOR
RESOLVER TO DIGITAL
LOOK-UP TABLE
PROFILE CALCULATOR
OPERATING DATA
FEED LENGTH
DAMPING CONSTANT
BEGIN F/A
END F/A
TRIM SENSOR
PRESS POSITION (RESOLVER)
ENCODER F/B
POWER
MTR
ENC
IFB-1
IFB-2
VFB-1
VFB-2
ICMD-1
ICMD-2
VCMD-1
VCMD-2
PCMD-2
PFB-2
d/dt
∫dt
54
76
62
68
106
108
110
112
114
116
118
120
122
124
126
128
130
132
134
138
140
142
144
146
148
150

STAMPING PRESS DAMPED FOLLOWER LOOP CONTROL SYSTEM

This is a continuation of application Ser. No. 08/588,991, filed Jan. 19, 1996, now abandoned.

BACKGROUND OF THE INVENTION

Present day coiled material feeding equipment have limitations which prevent or compromise high cycle rate press operation. It is desireable to position the coiled material press stock in the press stamping machine in the shortest period of time possible in order to speed up the stamping process. A result of attempts to attain these high cycle rates is that very high material accelerations are produced by the intermittent feeding devices. These high accelerations cause unstable reactions in the material storage loop which results in the following two undesirable effects. First, the forces generated by loop instability cause slippage between the stock material and the rolls of the intermittent feeding device. This results in inaccurate lengths of material being fed into the stamping press. Second, the reaction forces cause deformation of the coiled material, resulting in poor quality stamped parts or die malfunctions in the stamping press. Accordingly, material storage loop instability is often the limiting factor in the ability of the stamping system to perform satisfactorily at high cycle rates. Past methods of loop control have met with varying degrees of success in reducing material storage loop instability.

FIG. 1 represents a common hanging "U" loop, wherein the material is suspended in an unsupported loop between the straightening machine and the intermittent feed device of the machine press. This coiled material delivery system is very susceptible to loop reaction and is rarely employed at high cycle rates. FIG. 1 illustrates stamping press 20 receiving coiled stock material from a prior art U-shaped coil loop feed arrangement 22, wherein coiled stock a material 24 is stored on unwind reel or uncoiler 26 and is delivered to stamping press 20 via coiled stock material straightening device 28, consisting of feed rollers 60 and straightening rollers 61, and intermittent feed device 30. Coiled material straightening device 28 and intermittent feed device 30 are spaced apart so that as stock material 24 is delivered to stamping press 20, a U-shaped buffer loop is formed for the purpose of dampening the effects of loop reaction caused by the high acceleration generated by intermittent feed device 30.

FIG. 2 illustrates the dual loop "S" system as disclosed in U.S. Pat. No. 3,817,067 in which a guiding apparatus is utilized for the upper and lower sections of the S-shaped loop in the S-shaped buffer device. In this manner, the coiled material loop is monitored and supported to achieve more stable loop performance. FIG. 2 illustrates stamping press 20 receiving stock material from S-shaped coil loop feed arrangement 32, wherein coiled material supply loop 34 is advanced through coiled material straightening device 28, S-shaped buffer device 36, and intermittent feed device 30. A detailed description of the operation of such an S-shaped coil loop feed arrangement may be found in U.S. Pat. No. 3,817,067 which is incorporated herein by reference. In general, S-shaped buffer 36 includes guiding and supporting apparatus for the upper and lower sections of the S-shaped loop.

FIG. 3 illustrates a loop system which is driven by a servomotor as disclosed in U.S. Pat. No. 5,392,977 in which coil loop position sensors and an electronic controller are used in conjunction with a servomotor which drives the intermittent feed rollers so as to limit coil material fluttering during high speed operation. FIG. 3 illustrates stamping press 20 receiving stock material from a servomotor driven loop system 38 in which coiled material 24 is delivered to stamping press 20 along material supply loop 34 via feed driver 40 and intermittent feeding device 30. Driver 40 consists of servomotor 42 which drives feed rollers 44. Loop position sensors 46 and 48 monitor the position of stock material loop 50, 52 and generate loop position output signals which are input into electronic controller 5. Controller 5 controls servomotor 42 so as to maintain the length of the material feed loop between minimum loop length 50 and maximum loop length 52.

SUMMARY OF THE INVENTION

In general, the present invention provides a method to distribute the high accelerating forces created by an intermittent feeding device. By disposing damped follower rollers between the straightener feed rollers and the intermittent feed rollers, two separate material storage loops are formed. In this manner unstable loop reaction is distributed between the two separate material storage loops and is substantially reduced. This arrangement provides satisfactory loop performance at significantly higher press cycle rates than is currently achievable in present coiled material feeding systems.

More particularly, the invention relates to a high cycle rate coiled material feeding apparatus which utilizes an electronic control system in conjunction with an intermittent feed device for delivering a more uniform, accurate and undamaged supply of coiled stock material to the stamping press. In addition to an intermittent feeding device, the present invention involves interposing an intermediate damped follower stock material drive section between the coiled stock feeding device and the intermittent feeding device such that upper and lower storage loops are formed. The coiled stock feeding device is often incorporated in a straightening device such as shown in FIGS. 1, 2 and 4. In this manner the loop reaction associated with the high accelerating forces of the intermittent feeding device are distributed between the two separate upper and lower material storage loops.

The coiled stock feeding device and the intermediate damped follower device generally consist of drive rolls which are driven by servomotors. The speed control of the servomotors is controlled by an electronic controller which responds to trim signals generated by sensors monitoring the upper and lower loop positions. The intermittent feed rollers produce a cyclic start-stop motion characterized by very high material acceleration/deceleration followed by a dwell period characterized by zero velocity. This start-stop motion is in accordance with the stamping press operation which involves a repeating operating sequence of a press cycle followed by a dwell period.

FIG. 5 shows the relationship between the intermittent feed rollers, damped follower rollers and straightener feed rollers over time. The straightener feed rollers may be characterized by a constant, as shown, or sinusoidal velocity profile. The damped follower rollers loop produce a velocity profile which is in phase with that of the intermittent feeding rollers, but maintains a non-zero velocity during the press sequence dwell period associated with the intermittent feeding device. In this manner the resulting velocity profile requires a lower acceleration to achieve equal throughput (i.e., that length of stock material advanced through a particular stage) as compared to that of the intermittent feeding rolls. The amount of damping, which effects the dwell period velocity, the peak cycle velocity and the acceleration associated with the damped follower and straightener feed rollers, is adjustable by means of a damping constant resident in the electronic controller and may be adjusted for each application.

The stability of the upper and lower storage loops created by the use of the damped follower roller is of great importance and is critical to the satisfactory performance of the stamping system at high cycle rates. The behavior of the material in these loops is affected by the accelerating forces resulting from changes in the velocity of the material entering and exiting each loop section during a given time interval. An imbalance between the material velocity entering the loop as compared with that leaving the loop will create instability in the loop. If this instability becomes excessive, the undesirable effects of material slippage and deformation may occur. According to the present invention, the ability to control and minimize velocity imbalance will produce significant improvements in loop stability. Accordingly the damped follower system described herein will lessen the imbalance in the upper loop by transferring some of the imbalance to the lower loop, resulting in a more evenly distributed loop reaction.

The straightener feed rollers, which feed the lower loop, run at a constant velocity and produce the same throughput as the intermittent feed rollers. According to the present invention, trim sensors monitor the upper and lower loop positions and generate output signals which are communicated to an electronic controller for processing. The control system incrementally adjusts or "trims" the delivery of the coiled material to correct for long-term error and thereby maintains the ideal velocity profiles illustrated in FIG. 5. In this manner slippage between the feed rollers and the coiled material, an example of long-term error, is compensated for and effectively eliminated. The present loop control system uses damped follower servomotor driven drive rollers to distribute the effects of loop reaction, thereby reducing material slippage and deformation high cycle rate press operation.

In addition, the damped follower arrangement of the present invention reduces the load associated with the intermittent feed device and the material fluttering associated with high speed press operation.

In one embodiment, the invention provides an apparatus for supplying coiled stock material to a stamping press. This stock material supplying apparatus includes stock feed rollers which are driven by a stock feed roller servomotor and which receive stock material from a coiled stock supply. Damped follower rollers are driven by a damped follower servomotor and receive stock material from the stock feed rollers and an intermittent feed device receives stock material from the damped follower rollers and feed the stock material to the stamping press. The stock material is disposed between the stock feed rollers, the damped follower rollers and the intermittent feed device so as to form a loop of stock material. A loop sensor detects the length of the loop of stock material and generates an output signal representative of the length of the loop of stock material. A press position sensor monitors the position of the stamping press and generates a signal representative of the press position. A controller receives the loop sensor output signal and the press position sensor output signal and generates an output driving the damped follower servomotor and the stock feed servomotor, thereby minimizing the reaction shock associated with high speed stock material advancement.

In another embodiment, the present invention provides a method of high speed advancing coiled stock material from a coiled stock material supply toward a stamping press including the following steps. Coiled stock material is advanced from a coiled material supply toward a set of straightening rollers which renders generally straight stock material. The generally straight stock material is advanced through a set of damping rollers so as to form a lower loop of stock material between the straightening rollers and the damping rollers and an upper loop of stock material between the damping rollers and an intermittent feed device. The position of the lower and upper loops of stock material and the position of the press are monitored and signals representative of such information are generated and input to an electronic controller. The controller provides a control signal for maintaining a constant velocity advancement of stock material toward the straightening rollers and a non-zero, non-constant velocity of stock material toward the intermittent feed device such that equal lengths of stock material are advanced through the straightening rollers, the damping rollers, and the intermittent feed device. dr

BRIEF DESCRIPTION OF THE DRAWINGS

The above mentioned and other advantages and objects of this invention, and the manner of attaining them, will become more apparent and the invention itself will be better understood by reference to the following description of embodiments of the invention taken in conjunction with the accompanying drawings, wherein:

FIG. 6 illustrates a schematic diagram of the electronic control system of the damped follower loop control system of FIG. 4.

Figure 1:
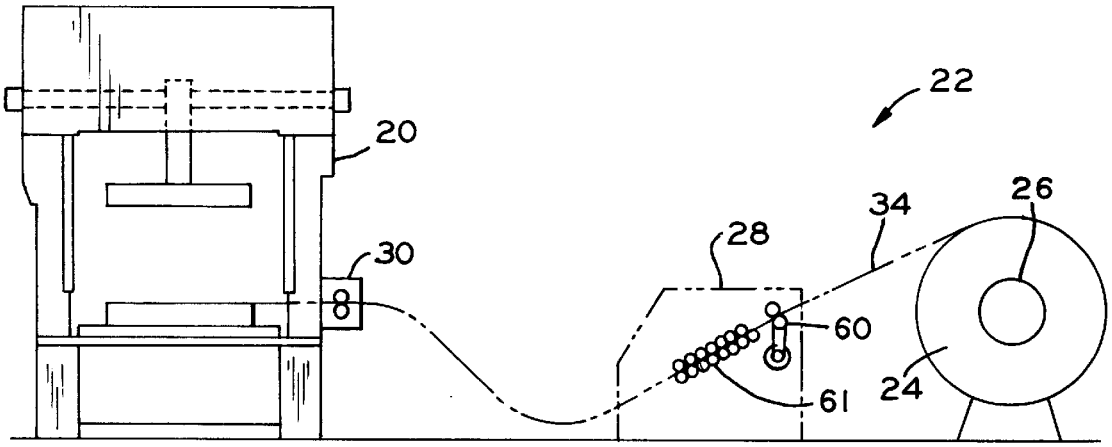
FIG. 1 PRIOR ART
FIG. 1 illustrates a stamping press utilizing a prior art U-shaped coiled loop feed arrangement.
Figure 2:
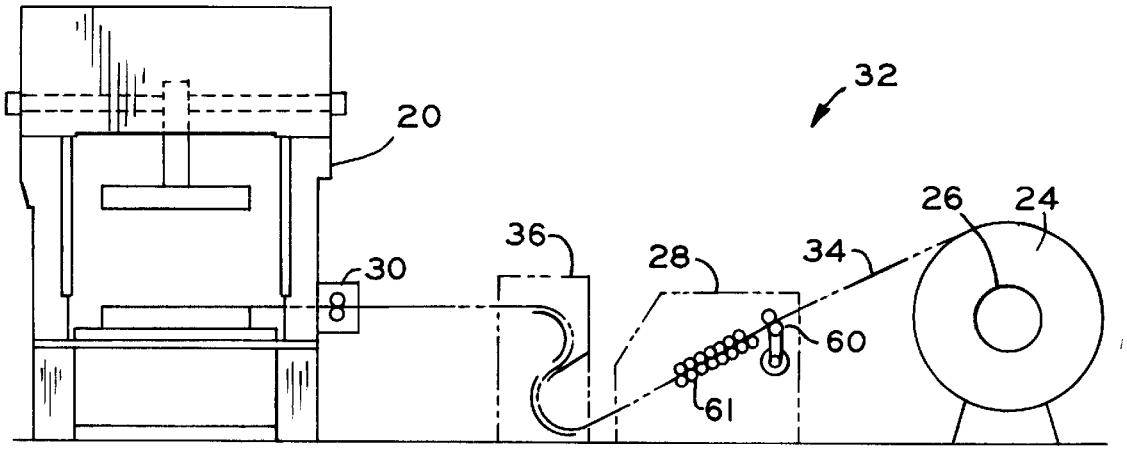
FIG. 2 PRIOR ART
FIG. 2 illustrates a stamping press utilizing a prior art S-shaped coiled loop feed arrangement.
Figure 3:
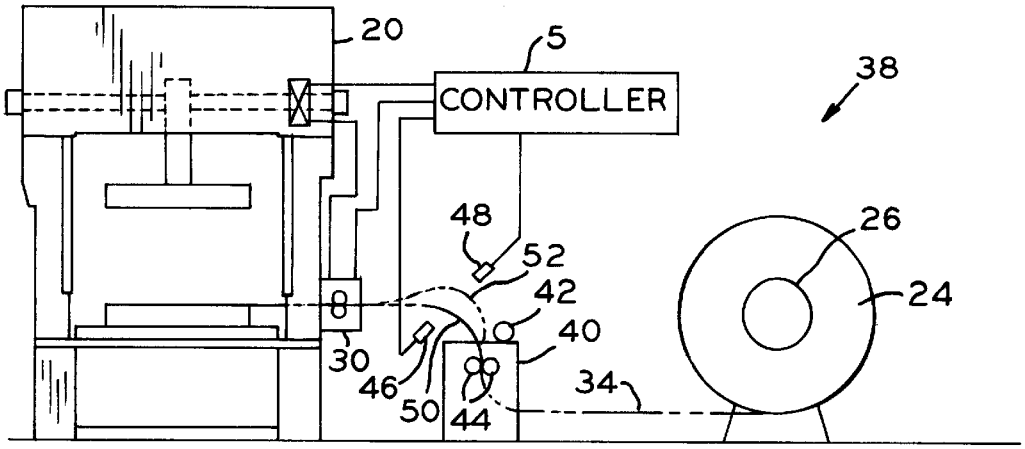
FIG. 3 PRIOR ART
FIG. 3 illustrates a stamping press utilizing a loop system driven by a servomotor which is controlled by a loop position monitoring and control system.

Corresponding reference characters indicate corresponding parts throughout the several views. Although the drawings represent embodiments of the invention, the drawings are not necessarily to scale and certain features may be exaggerated or omitted in order to better illustrate and explain the present invention.

DETAILED DESCRIPTION OF THE INVENTION

Figure 4:
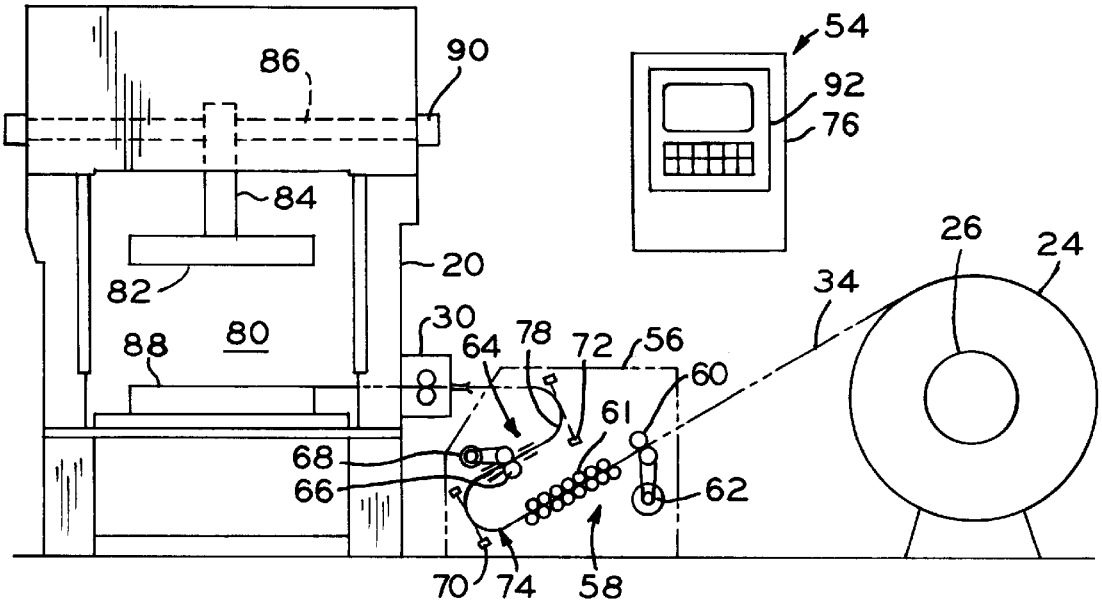
FIG. 4 illustrates a stamping press utilizing the damped follower loop control system of the present invention.

FIG. 4 illustrates stamping press 20 operating in conjunction with the present invention damped follower loop control system 54, wherein coiled stock material 24 is unwound from unwind reel 26 along supply loop 34 and is advanced through damped follower device 56, through intermittent feed device 30 and into stamping press 20. The embodiment shown in FIG. 4 discloses intermittent feed device 30 as a roller-type feed device. In the alternative, intermittent feed device 30 may be comprise a gripped-type feed device as is commonly used in the industry. Stamping press 20 comprises a motor, a flywheel for storing the rotational force of the motor, a clutch brake for taking out the rotational force of the flywheel (not shown), crankshaft 86, lower die 88 and rotational angle detection device 90, also known as a position resolver (see FIG. 4). Crankshaft 86 converts the rotational force of the flywheel into a linear reciprocal motion of the combination of link 84 and upper die 82. Damped follower device 56 includes coiled material straightener section 58, and a damped follower section 64. Coiled material straightener section 58 includes feed rollers 60, which are driven by servomotor 62, and straightener rollers 61. Damped follower section 64 includes damped follower rollers 66, which are driven by servomotor 68, lower loop position sensor 70 and upper loop position sensor 72.

Servomotor 62 drives feed rollers 60 so as to unwind coiled material 24 from unwind reel 26 along supply loop 34. Straightening rollers 61 serve to remove material curvature caused by storing material 24 in the coiled shape. The generally straightened coil material exits straightening section 58 and is advanced through damped follower rollers 66 so as to form lower storage loop 74. Lower loop position sensor 70 monitors the loop position and provides a "trim" signal to loop controller 76 for long term control of lower storage loop 74. Damped follower drive rolls 66 are driven by servomotor 68 so as to feed material 24 into intermittent feed device 30, thereby forming upper storage loop 78. Material from upper storage loop 78 is fed into the entry side of intermittent feeding device 30, which moves a precise amount of material, known as the feed length, into press die area 80 during the dwell period of each press cycle, known as the feed angle.

Upper die section 82 is attached to connecting link 84 which is in turn attached to crankshaft 86. As crankshaft 86 is caused to rotate, connecting link 84 and upper die section 82 are caused to move in a reciprocating manner toward and away from lower die section 88. In this manner stock material fed into press die area 80 is "stamped" into usable parts. Position resolver 90 is attached to crankshaft 86 so as to provide angular crankshaft position feedback to controller 76.

Operator-machine interface 92, typically a key pad and display, allows an operator to input application specific information into controller 76. In this manner, controller 76 utilizes application specific information in conjunction with press position feedback information and trim sensor feedback information to control the speed of feed roller servomotor 62 and damped follower servomotor 68. Accordingly, controller 76 receives loop position information from lower and upper loop position sensors 70 and 72 and angular crankshaft position information from position resolver 90 and generates control signals to drive feed roller servomotor 62 and damped follower servomotor 68 so as to maintain the optimum velocity profiles illustrated in FIG. 5.

Figure 5:
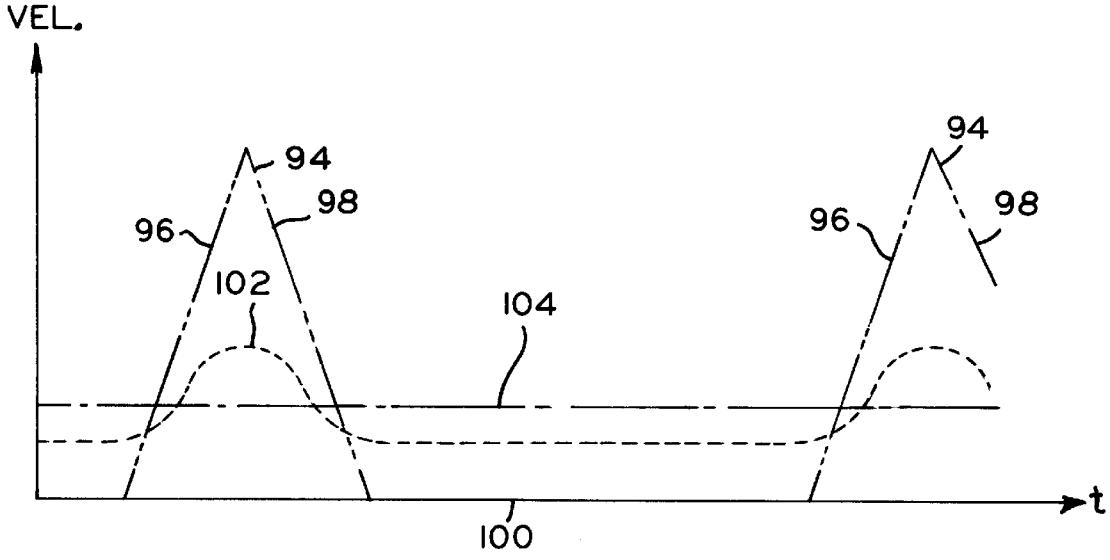
FIG. 5 illustrates the preferred velocity profiles associated with the damped follower loop control system of FIG. 4.

The operation of stamping press 20 being characterized by a repeating sequence of a press cycle followed by a feed period. FIG. 5 illustrates the relationship between the velocity of the three stock material advancing components illustrated in FIG. 4, intermittent feeding device 30, intermediate damped follower rollers 66, and feed rollers 60. Intermittent feeding device velocity profile 94 represents the cyclic start-stop motion characterized by very high stock material acceleration and deceleration associated with intermittent feeding device 30, this corresponds to the feed period during stamping press operation. Up-slope 96 represents very high material acceleration and down-slope 98 represents very high material deceleration, which is then followed by dwell period 100 of zero velocity, which corresponds to the press cycle of stamping press operation. Damped follower velocity profile 102 is in phase with intermittent feeding device velocity profile 94, although it is characterized by a lower maximum velocity and by a continuously non-zero velocity.

In accordance with velocity profiles 94 and 102, the distances which the coiled material moves through damped follower rollers 66 and intermittent feed device 30 during a given press cycle, i.e. the "throughput", are equal. In this manner, the resultant velocity profiles of the coil material as it is fed through feed rollers 60 and intermediate rollers 66 require a lower acceleration to achieve throughput equal to that of intermittent feeding device 30. Accordingly, a decrease in loop reaction results at lower loop 74 and upper loop 78. The degree of damping, which is controlled by controller 76, affects the dwell period velocity, the peak cycle velocity, and the acceleration associated with damped follower rollers 62. The amount of damping is adjustable by means of a damping constant and may be selected for each application as required. Straightener feed roller velocity profile 104 reflects a constant velocity feed of lower loop material 74 which again produces the same throughput as intermittent feeding device 30 and damped follower rolls 66.

As controller 76 receives information from loop position sensors 70 and 72 indicating that upper and lower loops 74 and 78 are in need of adjustment, controller 76 superimposes a requisite amount of trim upon the ideal velocity profiles of FIG. 5 to correct for long term error. At high cycle rates it is imperative that loop control system 54 controls servomotors 62 and 68 so that upper and lower storage loops 74 and 78 are stable so as to enhance performance during high speed stamping operation. The behavior of the material in loops 74 and 78 is affected by the accelerating forces resulting from changes in the velocity of the material entering and exiting each loop during stamping press and stock feed operation. An imbalance between the material velocity entering the loop as compared with that leaving the loop will create instability in the loop. If this instability becomes excessive, the undesirable effects of material slippage and deformation can occur.

FIG. 6 represents a block diagram of the functional processing blocks associated with damped follower loop controller 76. Operating data block 106 represents information which is input via operator-machine interface 92 and which includes feed length, damping constant, begin feed angle and ending feed angle. This information is input into profile calculator 108 and velocity calculator 110. Press position information from rotational angle detection device 90 is provided at press position block 112 and is input into resolver to digital block 114. Trim sensor signals 124 and 126 generated by loop sensors 70 and 72 are input into controller 76 via signal integrators 116 and 118.

With regards to straightener feed roller velocity control, resolver to digital converter 114 generates a digital output corresponding to the press position and outputs this digital representation to trajectory generator 120 and signal differentiator 122. Differentiator 122 determines the angular velocity of the press based upon time based samples of the digital position information. Signal integrators 116 and 118 determine the percentage of time that trim input signals 124 and 126 are turned on during a time based sampling period.

Velocity calculator 110 determines straightener feed roller velocity by multiplying the feed length data by the derived angular velocity of the press as generated by differentiator 122. If the integrated trim signal on-time remains between preestablished upper and lower limits, i.e. within the deadband, no adjustment is made to the calculated straightener feed roller velocity. If the on-time exceeds the upper limit, indicating that the loop storage is increasing, a trim value is subtracted from the calculated velocity. Conversely, if the trim on-time is less than the lower limit, indicating that the loop storage is decreasing, the trim value is added to the calculated velocity.

Velocity calculator 110 generates an output representative of the velocity command signal (VCMD-1) which is applied to velocity amplifier 128. Velocity decoder 130 converts feedback from incremental encoder 132 to a velocity feedback signal (VFB-1). Velocity amplifier 128 compares VCMD-1 to VFB-1 and produces a current command output (ICMD-1) which is a function of the difference between these two signals. Power amplifier 134 compares ICMD-1 to a current feedback signal (IFB-1) and produces the current output to control the rotational speed of the straightener feed drive motor 62.

With regard to damped follower drive velocity control, profile calculator 108 accepts parameters from operator-machine interface 92 as represented by block 106 and creates look-up table 138 which designates damped follower roller positions corresponding to incremental press angular positions. Trajectory generator 120 samples the digital press position input as generated by resolver to digital convertor 114. The damped follower roller position corresponding to the current press position represents the current ideal damped follower position.

Signal integrator 116 determines the on-time of trim input signal 126 during each sampling interval. If the integrated trim signal on-time remains between preestablished upper and lower limits, i.e. within the deadband, no adjustment is made to the calculated follower position. If the on-time exceeds the upper limit, indicating that the loop storage is increasing, a trim value is subtracted from the calculated position. Conversely if the trim on-time is less than the lower limit, indicating that the loop storage is decreasing, the trim value is added to the calculated position.

The output of trajectory generator 120 represents the position command signal (PCMD-2) for damped follower drive rollers 66. The PCMD-2 signal is delivered to the input of velocity amplifier 140 which produces a position command output signal (VCMD-2). VCMD-2 is a function of the difference between the signals PCMD-2 and PFB-2. The VCMD-2 signal is delivered to velocity amplifier 142 and position/velocity decoder 144 converts feedback from incremental encoder 146 to a feedback signal (VFB-2). Velocity amplifier 142 compares the VCMD-2 signal to the VFB-2 signal and produces a current command output (ICMD-2), which is a function of the difference between these two signals. Power amplifier 148 compares ICMD-2 to a current feedback signal (IFB-2) and generates current output 150 which controls the rotational speed of damped follower drive motor 68.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for supplying coiled stock material into a stamping press, the apparatus comprising;

a stock feed roller driven by a stock feed roller servomotor and positioned to receive stock from a coiled stock supply;

a damped follower roller driven by a damped follower servomotor and positioned to receive stock material from said stock feed roller;

an intermittent feed device positioned to receive stock material from said damped follower roller and adapted to feed the stock material into a stamping press creating a reaction shock force within the stock material, the stock material being disposed between said stock feed roller, said damped follower roller and said intermittent feed device so as to form a s-shaped loop of stock material;

a loop length sensor positioned to detect the length of said loop of stock material and adapted to generate an output signal representative of the length of said loop of stock material;

a feed angle sensor positioned to detect the feed angle of a stamping press and adapted to generate a signal representative of the press position; and a controller communicatively connected to said loop length sensor and said feed angle sensor and controllably connected to said damped follower servomotor and said stock servomotor to cause said follower roller and said feed roller to be substantially in phase with each other so that said reaction shock force associated with high stock material advancement is dampened.

2. The coiled stock supplying apparatus of claim 1, wherein said loop of stock material comprises a lower loop and an upper loop of stock material.

3. The coiled stock supplying apparatus of claim 2, wherein said loop length sensor comprises a lower loop length sensor positioned to detect the length of said lower loop of stock material and adapted to generate an output signal representative of the length of said lower loop of stock material and an upper loop length sensor positioned to detect the length of said upper loop of stock material and adapted to generate an output signal representative of the length of said upper loop of stock material.

4. The coiled stock supplying apparatus of claim 1, further comprising a straightening roller positioned to receive the coiled stock material from said stock feed roller and adapted to render a generally straightened supply of stock material, said damped follower roller positioned to receive said generally straightened supply of stock material.

5. The coiled stock supplying apparatus of claim 1, wherein said stock feed roller is adapted to advance the stock material at a substantially constant non-zero velocity toward said damped follower roller.

6. The coiled stock supplying apparatus of claim 5, wherein said damped follower roller is adapted to advance the stock material toward said intermittent feed device at a substantially non-zero velocity.

7. The coiled stock supplying apparatus of claim 1, wherein the stamping press operation is characterized by a repeating sequence of a press cycle followed by a feed period, said damped follower roller adapted to provide a positive acceleration of stock material toward said intermittent feed device during a first half of the feed period, a deceleration of stock material toward said intermittent feed device during a second half of the feed period, and a generally constant non-zero velocity of stock material toward said intermittent feed device during the press cycle.

8. The coiled stock supplying apparatus of claim 7, wherein said intermittent feed device is adapted to maintain a generally zero velocity advancement of stock material to the stamping press during the press cycle and to provide a very high positive acceleration of stock material toward the stamping press during the first half of the feed period and a very high deceleration of stock material toward the stamping press during the second half of the feed period.

9. The coiled stock supplying apparatus of claim 8, wherein said intermittent feed device stock material acceleration is greater than said damped follower roller stock material acceleration and said intermittent feed device deceleration is greater than said damped follower roller deceleration.

10. The coiled stock supplying apparatus of claim 9, wherein said damped follower stock material acceleration and deceleration and said intermittent feed device stock material acceleration and deceleration produce a generally sinusoidal velocity profile.

11. The coiled stock supplying apparatus of claim 7, wherein said controller is controllably connected to said stock feed roller and said damped follower roller, whereby equal lengths of the stock material are advanced through said stock feed roller, damped follower roller, and said intermittent feed device during each repeating stamping press sequence of operation.

12. The coiled stock supplying apparatus of claim 1, wherein said controller is adapted to adjust the amount of damping according to a predefined damping constant, whereby said stock feed roller, damped follower roller, and intermittent feed device are characterized by optimum velocity profiles.

13. The coiled stock supplying apparatus of claim 12, wherein said controller is adapted to adjust said velocity profiles, whereby error resulting from press operation is effectively corrected.

14. The coiled stock supplying apparatus of claim 12, wherein said controller is adapted to adjust said predefined damping constant, whereby said velocity profiles are effectively matched with the stamping press operational characteristics.

15. In an apparatus for supplying coiled stock material to a stamping press, a stock supply apparatus having a stock feed roller driven by a stock feed roller servomotor, and an intermittent feed device, a high speed stock material advancing system comprising:

a damped follower roller driven by a damped follower servomotor and positioned to receive stock material from the stock feed roller, the intermittent feed device positioned to receive the stock material from said damped follower roller, whereby a loop of stock material is formed;

a sensor positioned to detect the length of said loop of stock material and adapted to generate an output signal representative of the length of said loop of stock material;

a feed angle sensor positioned to detect the feed angle of the stamping press and adapted to generate a signal representative of the press position; and a controller communicatively connected to said loop length sensor and said feed angle sensor and controllably connected to said damped follower servomotor and said stock feed roller servomotor to cause said follower roller and said feed roller to be substantially in phase with each other, so that said loop of stock material is maintained between predetermined minimum and maximum lengths.

16. The high speed stock material advancing system of claim 15, wherein said loop of stock material comprises a lower loop and an upper loop of stock material.

17. The high speed stock material advancing system of claim 16, wherein said loop length sensor comprises a lower loop length sensor positioned to detect the length of said lower loop of stock material and adapted to generate an output signal representative of the length of said lower loop of stock material and an upper loop length sensor positioned to detect the length of said upper loop of stock material and adapted to generate an output signal representative of the length of said upper loop of stock material.

18. The high speed stock material advancing system of claim 15 further comprising a straightening roller positioned to receive the coiled stock material from said stock feed roller and adapted to render a generally straightened supply of stock material, said damped follower roller positioned to receive said generally straightened supply of stock material.

19. The high speed stock material advancing system of claim 15, wherein the stock feed roller is adapted to advance the stock material at a substantially constant non-zero velocity toward said damped follower roller.

20. The high speed stock material advancing system of claim 15, wherein said damped follower roller is adapted to maintain a substantially non-zero velocity in advancing the stock material toward said intermittent feed device.

21. The high speed stock material advancing system of claim 15, wherein the stamping press operation is characterized by a repeating sequence of a press cycle followed by a feed period, said damped follower roller adapted to provide a positive acceleration of stock material toward said intermittent feed device during a first half of the feed period, a deceleration of stock material toward said intermittent feed device during a second half of the feed period, and a generally constant non-zero velocity of stock material toward said intermittent feed device during the press cycle, whereby stock material reaction to high speed advancement is dampened.

22. The high speed stock material advancing system of claim 21, wherein said intermittent feed device is adapted to maintain a generally zero velocity advancement of stock material toward the stamping press during the press cycle and to provide a very high positive acceleration of stock material toward the stamping press during the first half of the feed period and a very high deceleration of stock material toward the stamping press during the second half of the feed period.

23. The high speed stock material advancing system of claim 22, wherein said damped follower stock material acceleration and deceleration and said intermittent feed device stock material acceleration and deceleration produce a generally sinusoidal velocity profile.

24. The high speed stock material advancing system of claim 15, wherein said controller is adapted to adjust the amount of damping according to a predefined damping constant, whereby said stock feed rollers, damped follower rollers, and intermittent feed device are characterized by optimum velocity profiles.

25. The high speed stock material advancing system of claim 24, wherein said controller is adapted to adjust said velocity profiles, whereby error resulting from press operation is effectively corrected.

26. The high speed stock material advancing system of claim 24, wherein said controller is adapted to adjust said predefined damping constant, whereby said velocity profiles are effectively matched with the stamping press operational characteristics.

27. A method of high speed advancing coiled stock material from a coiled stock material supply toward a stamping press comprising the steps of:

feeding coiled stock material from a coiled material a feed roller;

interweaving the stock material from the feed roller through a pair of damping rollers and an intermittent feed device so as to form a lower loop of stock material between the feed roller and the damping rollers and an upper loop of stock material between the damping rollers and the intermittent feed device and feeding the stock material into the press;

detecting the position of the lower and upper loops of stock material and the position of the press and generating signals representative of such position information; and receiving and processing the position information derived from the preceding step by use of an electronic controller and providing a control signal for driving the damping rollers and the feed roller to cause said follower roller and said feed roller to be substantially in phase with each other so as to minimize the reaction shock associated with high speed stock material advancement.

28. The method of high speed advancing coiled stock material of claim 27 wherein the stamping press operation is characterized by a repeating sequence of a press cycle followed by a feed period, further comprising the step of maintaining a substantially constant velocity advancement of stock material toward the feed roller during the stamping press operation.

29. The method of high speed advancing coiled stock material of claim 28, further comprising the step of maintaining a positive acceleration of stock material toward said intermittent feed device during a first half of the feed period, a deceleration of stock material toward said intermittent feed device during a second half of the feed period, and a generally constant non-zero velocity of stock material toward said intermittent feed device during the press cycle.

30. The method of high speed advancing coiled stock material of claim 28, further comprising the step of maintaining a generally zero velocity advancement of stock material toward the stamping press during the press cycle and a very high positive acceleration of stock material toward the stamping press during the first half of the feed period and a very high deceleration of stock material toward the stamping press during the second half of the feed period.

31. The method of high speed advancing coiled stock material of claim 30, further comprising the step of maintaining damped follower stock material acceleration and deceleration and intermittent feed device stock material acceleration and deceleration to result in a generally sinusoidal velocity profile.

32. The method of high speed advancing coiled stock material of claim 27, further comprising the step of adjusting the amount of damping according to a predefined damping constant resident in the controller said stock feed rollers, damped follower rollers, and intermittent feed device are characterized by optimum velocity profiles.

* * * * *